US010892838B2

(12) United States Patent
Cruickshank, III et al.

(10) Patent No.: US 10,892,838 B2
(45) Date of Patent: Jan. 12, 2021

(54) HETEROGENEOUS NETWORK TOPOLOGY MANAGEMENT AND CONTROL

(71) Applicants: Alliance for Sustainable Energy, LLC, Golden, CO (US); The Regents of the University of Colorado, a body corporate, Denver, CO (US)

(72) Inventors: Robert Fraser Cruickshank, III, Big Indian, NY (US); Bri-Mathias Scott Hodge, Golden, CO (US); Anthony Reed Florita, Broomfield, CO (US)

(73) Assignees: Alliance for Sustainable Energy, LLC, Golden, CO (US); The Regents of the University of Colorado, a body corporate, Denver, CO (US)

( * ) Notice: Subject to any disclaimer, the term of this patent is extended or adjusted under 35 U.S.C. 154(b) by 37 days.

(21) Appl. No.: 16/185,903

(22) Filed: Nov. 9, 2018

(65) Prior Publication Data

US 2019/0140756 A1 May 9, 2019

Related U.S. Application Data

(60) Provisional application No. 62/583,847, filed on Nov. 9, 2017.

(51) Int. Cl.
*H04H 60/96* (2008.01)
*H04H 60/78* (2008.01)
(Continued)

(52) U.S. Cl.
CPC ..... *H04H 60/96* (2013.01); *H04H 20/12* (2013.01); *H04H 60/70* (2013.01); *H04H 60/78* (2013.01);
(Continued)

(58) Field of Classification Search
None
See application file for complete search history.

(56) References Cited

U.S. PATENT DOCUMENTS 5,008,843 A * 4/1991 Poelsler ..... G01D 3/022 702/104
2008/0046387 A1* 2/2008 Gopal ..... G01D 4/004 705/412
(Continued)

*Primary Examiner* — Pankaj Kumar
*Assistant Examiner* — Timothy R Newlin
(74) *Attorney, Agent, or Firm* — Robert G. Pittelkow

(57) ABSTRACT

In one aspect, the present disclosure may provide devices or systems configured to receive indications of geographic areas, each corresponding to distribution networks, and determine whether the distribution networks overlap. The processor(s) may also be configured to receive parameter value(s) obtained by a device within one distribution network at a location within an overlapping area, and cause device(s) within another distribution network to modify operation based on the parameter value(s). In another aspect, the present disclosure may provide devices that include a voltage sensor to measure a voltage of a power distribution network at a power consumption location that corresponds to the device. The device may be configured to provide at least one cable service to the power consumption location via a cable television (CATV) distribution network and output an indication the measured voltage value.

12 Claims, 6 Drawing Sheets

(51) Int. Cl.

| | |
|---|---|
| ***H04H 60/70*** | (2008.01) |
| ***H04H 20/12*** | (2008.01) |
| ***H04H 60/97*** | (2008.01) |
| *G06Q 50/06* | (2012.01) |
| *H04H 60/51* | (2008.01) |

(52) U.S. Cl.
CPC ..... *H04H 60/97* (2013.01); *G06Q 50/06* (2013.01); *H04H 60/51* (2013.01)

(56) References Cited

U.S. PATENT DOCUMENTS

| | | | | |
|---|---|---|---|---|
| 2009/0079632 | A1* | 3/2009 | Ochi | H01Q 3/242 342/372 |
| 2009/0089854 | A1* | 4/2009 | Le | H04N 21/6582 725/139 |
| 2010/0094479 | A1* | 4/2010 | Keefe | H02J 3/1878 700/298 |
| 2012/0123602 | A1* | 5/2012 | Sun | H02J 3/14 700/292 |
| 2014/0070756 | A1* | 3/2014 | Kearns | H02J 7/007 320/101 |
| 2015/0112501 | A1* | 4/2015 | Rombouts | H02J 3/14 700/295 |
| 2017/0045904 | A1* | 2/2017 | Nishita | G05F 1/66 |
| 2017/0098937 | A1* | 4/2017 | Huomo | H02J 3/383 |

* cited by examiner

HETEROGENEOUS NETWORK TOPOLOGY MANAGEMENT AND CONTROL

CROSS-REFERENCE TO RELATED APPLICATIONS

This application claims the benefit of U.S. Provisional Application No. 62/583,847, titled "HETEROGENEOUS NETWORK TOPOLOGY MANAGER" and filed Nov. 9, 2017, the entire content of which is incorporated herein by reference.

CONTRACTUAL ORIGIN

The United States Government has rights in this invention under Contract No. DE-AC36-08GO28308 between the United States Department of Energy and Alliance for Sustainable Energy, LLC, the Manager and Operator of the National Renewable Energy Laboratory.

BACKGROUND

Electric power distribution networks deliver electric power to consumers. Power quality can vary spatiotemporally across such networks with the ebb and flow of power supply and demand. Distribution system operators (DSOs) may utilize aggregate power quality information from locations in the power distribution network to account for such ebb and flow and to provision power in an efficient and reliable manner. Increasing penetration of distributed energy resources (DERs), such as photovoltaics (PV), on-site generators, battery systems, demand response systems, and others may lead to increasingly larger and potentially harmful variations in power quality across power distribution networks. Cable television (CATV) distribution networks deliver cable services, such as television programming, internet, and others, to many of the same consumers. CATV distribution networks have sensors that measure performance of power distribution networks at more granular, but still aggregate, levels.

SUMMARY

In one example, a system includes at least one cable service device having a processor and a voltage sensor. The at least one cable service device corresponds to a respective at least one power consumption location that is connected to a power distribution network, and the at least one cable service device is configured to: provide at least one cable service to the power consumption location via a cable television (CATV) distribution network, determine a voltage value representing a voltage of the power distribution network at the at least one power consumption location, and output the voltage value. The system also includes a heterogenous network topology management and control (HNTMC) device comprising a processor and configured to receive an indication of the voltage value and cause at least one device within the power distribution network to modify operation based on the voltage value.

In another example, a device includes a voltage sensor configured to measure a voltage value that represents a voltage of a power distribution network at a power consumption location that corresponds to the device and at least one processor communicatively coupled to the voltage sensor. The at least one processor is configured to provide at least one cable service to the power consumption location via a cable television (CATV) distribution network and output an indication the voltage value.

In another example, a device includes at least one processor configured to receive an indication of a first geographic area corresponding to a first distribution network, receive an indication of a second geographic area corresponding to a second distribution network, and determine, based on the first geographic area and the second geographic area, that at least a portion of the first distribution network and at least a portion of the second distribution network overlap in an overlapping geographic area. The at least one processor is further configured to receive at least one parameter value obtained by a device within the second distribution network, the at least one parameter value corresponding to a location within the overlapping geographic area, and cause at least one device within the first distribution network to modify operation based on the at least one parameter value of the second distribution network.

The details of one or more examples are set forth in the accompanying drawings and the description below. Other features, objects, and advantages will be apparent from the description and drawings, and from the claims.

DETAILED DESCRIPTION

Figure 1:
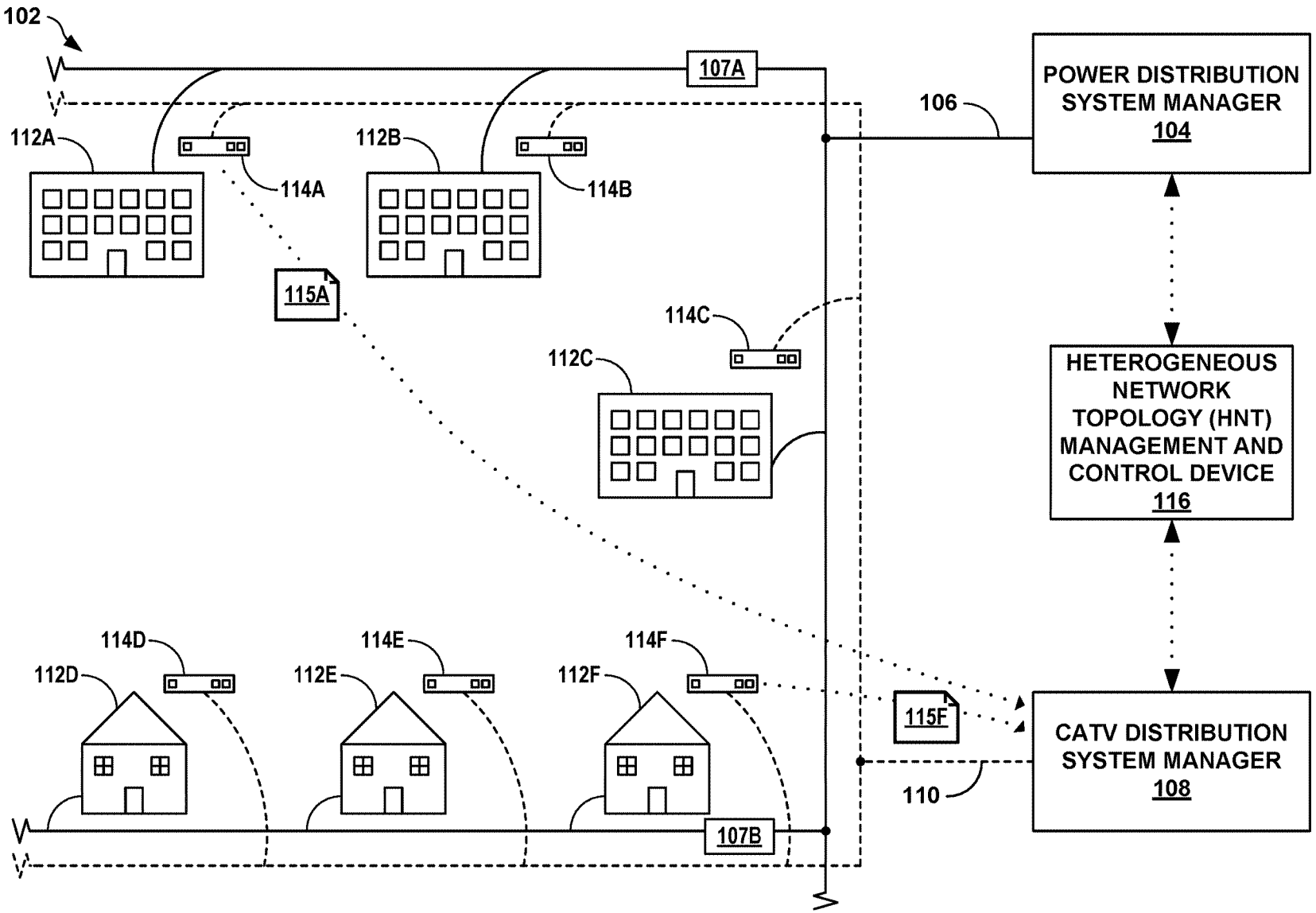
FIG. 1 is a conceptual diagram illustrating an example heterogeneous network topology (HNT) management and control system, in accordance with one or more aspects of the present disclosure.

The present disclosure provides systems, devices, and methods that may be used to improve management and control of two or more networks having heterogeneous topology. In one aspect, the techniques described herein provide cable service devices, for use within a cable television (CATV) distribution network, that can monitor and report electric power quality. For example, in addition to providing services (e.g., television programming, internet service, internet-based telephone services, etc.) to a consumer, a cable modem, CATV set-top box, or other cable service device may be configured to determine values of voltage, frequency, or other attributes of a power distribution network, at the consumer's location, and provide those values to the CATV distribution system manager.

In another aspect, the techniques of the present disclosure may allow information obtained from a first network, such as a CATV distribution network, to be used for management and control of a geographically overlapping second distribution network, such as a power distribution network, and vice versa. For example, a heterogenous network topology (HNT) management and control device may receive power quality information obtained by devices in a CATV distribution network and by devices in a power distribution network. The HNT management and control device may correlate the two distribution networks and associate received information from each of the networks with the other. The HNT management and control device may also utilize the combined information to manage and control the power distribution network and/or the CATV distribution network.

Power distribution networks are designed and built such that power quality delivered to consumers is within acceptable ranges. For example, in the United States, these ranges are specified by the American National Standards Institute (ANSI C84.1-2016). Power distribution system operators (DSOs) may use telemetry systems to remotely monitor power quality (e.g., measured voltage values, frequency values, and/or others) at aggregations of approximately 1,000 consumers and use this information as input signals to control the power distribution network. Finer resolution power quality information, for smaller groups of homes, is typically not available to DSOs. For example, voltages between phases and neutral are not available even in service areas where DSOs have deployed advanced metering infrastructure, CATV distribution networks often geographically overlay power distribution networks and CATV multiple system operators (MSOs) routinely obtain power quality information throughout the day from outside plant power supplies that serve groups of approximately 125 consumers. In fact, an international standards-based CATV power supply collection method (ANSI/SCTE 112 2005) is employed around the world by domestic MSO broadband providers as well as by international MSO broadband providers.

Analysis of recent studies of CATV power supply input voltage and frequency information shows that many groups of approximately 125 homes receive power quality well outside acceptable ANSI limits. That is, many ~125-home areas have high, low, and fluctuating voltages and frequencies. The observability limitations of the power distribution infrastructure leave utilities blind to end-of-line and last-mile power quality issues. Such issues may, however, be visible (or may be more easily visible) to CATV broadband providers.

Via straightforward, well established methods of Internet Protocol (IP) communication with servers at these MSOs, ongoing power quality information for the majority of the worldwide distribution grid could be aggregated via a high-speed messaging bus and routinely shared with DSOs for the purpose of improving network operations such as power quality monitoring, outage prediction, and service restoration, as well as improving overall system-level end-to-end efficiency of the grid.

The inverse question, "How may DSOs systematically share voltage and frequency measurements with CATV broadband (and other) providers?", is also of great interest. Power distribution network power quality telemetry readings obtained by DSOs, particularly operational vs. outage status, are valuable to widely dispersed large and small entities with a critical need to know of grid power failures such as MSOs, and other water, gas and/or emergency service providers.

By enabling common capture, storage, analysis, and forwarding of information between two or more networks having heterogenous topology, the techniques described herein may open up significantly more information, both geographically and temporally, about the status of the networks for management and control by distribution system operators. In addition, by enabling cable service devices to determine and transmit information about power quality at a consumer's location, the techniques of the present disclosure may provide an efficient, low-cost, and easy-to-implement alternative to related-art techniques hoping to provide DSOs with timely, granularized information about the power distribution network.

FIG. 1 is a conceptual diagram illustrating an example heterogeneous network topology (HNT) management and control system (e.g., system 102), in accordance with one or more aspects of the present disclosure. In the example of FIG. 1, system 102 includes power distribution system manager 104, power distribution network 106, CATV distribution system manager 108, and CATV distribution network 110. Power distribution network 106 includes telemetry devices 107A and 107B (collectively "telemetry devices 107"). System 102 also includes consumers 112A-112F (collectively "consumers 112"), cable service devices 114A-114F (collectively "cable service devices 114"), and heterogenous network topology (HNT) management and control device 116.

The example of FIG. 1 is for illustration only and system 102 represents only one example of a HNT management and control system. Various other systems, including more, fewer, or different devices and components may be used in accordance with the techniques of the present disclosure. For example, system 102 includes six of consumers 112. In some examples, HNT management and control systems may include any number of consumers.

In the example of FIG. 1, power distribution system manager 104 represents the infrastructure of a DSO. Power distribution system manager 104 may receive power from a transmission network or other source (not shown) and provision power to consumers 112. Power distribution system manager 104 may generally include hardware and software platforms that integrate numerous utility systems, provide automated outage restoration and optimization of distribution grid performance, and otherwise generally manage a power distribution network. Power distribution system manager 104 provides power to consumers 112 via power distribution network 106.

Power distribution network 106, in the example of FIG. 1, represents a physical network configured to distribute power to consumers 112. For example, power distribution network 106 may include wire conductors, insulators, switches, transformers, capacitors, load tap changers and/or other components. In other words, power distribution network 106 may represent the hardware necessary to distribute electrical power to consumers 112.

Power distribution network 106 includes telemetry devices 107. Examples of telemetry devices 107 may include supervisory control and data acquisition (SCADA) units, phasor measurement units (PMUs), and/or other devices. In other words, each of telemetry devices 107 may represent any device within power distribution network 106 that is configured to determine and provide values of power quality attributes to power distribution system manager 104. While only two telemetry devices are shown in the example of FIG. 1, power distribution networks may, in various examples, include any number of telemetry devices.

In the example of FIG. 1, telemetry devices 107 may determine values of power quality attributes, such as voltage, frequency, and/or others. Typically, telemetry devices may be located at aggregation points throughout a power distribution network, and thus power quality information provided by the telemetry devices may correspond to (often large) aggregations of consumers, instead of at the per-consumer level. In the example of FIG. 1, for instance, determinations by telemetry device 107A correspond to an aggregation of one third of power distribution network 106 (two of consumers 112), and determinations by telemetry device 107B correspond to an aggregation of one half of power distribution network 106 (three of consumers 112).

Telemetry devices 107 may output the determined power quality attribute values to power distribution system manager 104 for management and control of power distribution network 106. Typical power distribution network telemetry devices may determine and/or output such power quality information on a relatively slow timescale, such as once every 5 minutes, once every 15 minutes, or even slower. In the example of FIG. 1, telemetry devices 107 may only determine and transmit such power quality information once every 15 minutes.

In the example of FIG. 1, CATV distribution system manager 108 represents the infrastructure of a MSO. CATV distribution system manager 108 may provision cable services such as television programming, internet connectivity, voice over IP (VoIP) services, and others, to cable service devices 114 for use by consumers 112. CATV distribution system manager 108 may generally include network and element management systems and/or any other devices commonly used to manage a CATV distribution network. CATV distribution system manager 108 provides cable services via CATV distribution network 110.

CATV distribution network 110, in the example of FIG. 1, represents a physical and/or logical network configured to provide cable services to cable service devices 114 for use by consumers 112. For example, CATV distribution network 110 may include fiber optic and coax cable for carrying signals, neighborhood fiber nodes that provide optical to electrical conversion, network power supplies, various types of amplifiers for extending signals, and/or other components. In other words, CATV distribution network 110 may represent the hardware necessary to distribute cable services to consumers 112.

In the example of FIG. 1, consumers 112 represent homes, businesses, and/or any other power consumption locations within power distribution network 106. Consumers 112 are each associated with one of cable service devices 114. While each of cable service devices 114 is associated with a single respective consumer 112 in the example of FIG. 1, cable service devices may, in some examples, be associated with multiple consumers (e.g., when providing cable services to an apartment building). Additionally, in some examples, consumers may have two or more associated cable service devices (e.g., a cable modem and a set-top box). In some examples, certain consumers may not have any associated cable service devices.

Cable service devices 114, in the example of FIG. 1, represent cable modems, cable set-top boxes, VoIP provisioning devices, or any other devices capable of providing one or more cable services to consumers 112. In addition, cable service devices 114 are configured to determine values of power quality attributes (e.g., voltage values, frequency values, outages, and harmful deviations from ANSI limits or other specified limits, etc.) for power distribution network 106 at the location of the respective one of consumers 112. For example, cable service device 114A may be configured to determine a voltage value representing the voltage of power distribution network 106 at consumer 112A, cable service device 114B may be configured to determine a voltage value at consumer 112B, and so on.

Cable service devices 114 are also configured to output the determined power quality attribute values. For example, cable service device 114A may output quality information 115A. Cable service device 114F may output power quality information 115F. Power quality information 115A and 115F are collectively referred to herein as "power quality information 115". Cable services devices 114B-114E may also output respective power quality information but this is not shown in FIG. 1, for brevity. Power quality information 115 may be transmitted (e.g., via existing CATV distribution network infrastructure) to CATV distribution system manager 108.

Power quality information 115 may include a location identifier and information about the power quality at that location. In some examples, the location identifier may be information specifying a geographic location (e.g., coordinates or an address). In some examples, the location identifier may be information specifying a logical location, such as an IP address, a consumer identifier, a CATV distribution network position indicator, or any other information that may provide CATV distribution system manager 108 with a way to determine where in CATV distribution network 110 the information came from.

In some examples, power quality information 115 may include actual measurements made by cable service devices 114, such as voltage values, frequency values, and the like. In some examples, power quality information 115 may additionally or alternatively include inferred data that is generated based on the measurements. In some examples, power quality information 115 may not include voltage values. In other words, in various examples, power quality information 115 may include various measured and/or inferred information about power quality. Further details of an example cable service device are provided below with respect to FIG. 2.

System 102 includes HNT management and control device 116. HNT management and control device 116 may be configured to provide common capture, storage, analysis, and forwarding of power distribution network information and CATV distribution network information in order to enable improved management and control of power distribution network 106 and/or CATV distribution network 110. HNT management and control device 116 may be a computing device, such as a server computer, a desktop computer, or any other device capable of implementing some or all of the techniques described herein.

In some examples, HNT management and control device 116 may represent a cloud computing environment. That is, while shown as a single box and described as a "device" herein, HNT management and control device 116 may, in some examples, be a group of distributed computing resources that communicate with one another to perform at least some of the techniques described herein. In some examples, HNT management and control device 116 may be the same as or be physically collocated with power distribution system manager 104 or CATV distribution system manager 108. In other words, HNT management and control device 116 may, in some examples, be a part of power distribution system manager 104 or CATV distribution system manager 108. In some examples, such as the example shown in FIG. 1, power distribution system manager 104, CATV distribution system manager 108, and HNT management and control device 116 may be physically separated.

In accordance with the techniques of the present disclosure, HNT management and control device 116 may receive an indication of a first geographic area corresponding to a first distribution network. In the example of FIG. 1, for instance, HNT management and control device 116 may receive information from power distribution system manager 104 indicating a geographic area corresponding to power distribution network 106. HNT management and control device 116 may also receive an indication of a second geographic area corresponding to a second distribution network. In the example of FIG. 1, for instance, HNT management and control device 116 may receive information from CATV distribution system manager 108 indicating a geographic area of CATV distribution network 110.

Based on the first geographic area and the second geographic area, HNT management and control device 116 may determine that at least a portion of the first distribution network and at least a portion of the second distribution network overlap in an overlapping geographic area. For instance, HNT management and control device 116 may determine that power distribution network 106 an CATV distribution network 110 overlap in the geographic area covering consumers 112. Consequently, HNT management and control device 116 may generate one or more interfaces for translating data received from each distribution system manager into data usable by the other distribution manager.

HNT management and control device 116 may receive at least one parameter value of the second distribution network, the at least one parameter value corresponding to a location within the overlapping geographic area. For example, HNT management and control device 116 may receive, from CATV distribution system manager 108, voltage and/or frequency values that were included in power quality information 115 as received from consumers 112. HNT management and control device 116 may utilize the generated interface(s) to translate this data into data understandable and usable by power distribution system manager 104.

HNT management and control device 116 may cause at least one device within the first distribution network to modify operation based on the at least one parameter value of the second distribution network. That is, HNT management and control device 116 may cause at least one device within power distribution network 106 to modify operation based on the voltage and/or frequency values determined by devices within CATV distribution network 110. As one example, HNT management and control device 116 may cause a switch within power distribution network 106 to open, thus cutting off the flow of power through the switch and protecting at least a portion of the network. As another example, HNT management and control device 116 may cause a load tap changer within power distribution network 106 to change to a different tap to provide voltage support. As another example, HNT management and control device 116 may cause a DER within power distribution network 106 to add or shed load. As another example, HNT management and control device 116 may cause a DER inverter within power distribution network 106 to modify the proportions of active and/or reserve power provided to power distribution network 106.

In some examples, HNT management and control device 116 may determine appropriate changes to be made in power distribution network 106 and issue instructions to cause such changes. That is, in some examples HNT management and control device 116 may directly cause devices within power distribution network 106 to modify operation. In some examples, HNT management and control device 116 may cause devices within power distribution network 106 to modify operation by converting the voltage and/or frequency values into data understandable by power distribution system manager 104 and outputting that data to power distribution system manager 104, which in turn may cause devices within power distribution network 106 to modify operation. In some examples, HNT management and control device 116 may be configured both to directly cause devices to modify operation and to indirectly cause devices to modify operation.

In some examples, HNT management and control device 116 may additionally or alternatively cause at least one device within CATV distribution network 108 to modify operation based on parameter values from within power distribution network 106. That is, HNT management and control device 116 may be used for improved control of both distribution networks. In some examples, HNT management and control device 116 may be configured to receive information from more than two networks for use by multiple networks. One example of HNT management and control device 116 is further described with respect to FIGS. 3-5 below.

In accordance with the techniques of the present disclosure, cable service devices 114 provide the ability to obtain power quality information for a power distribution network at the per-consumer level. Furthermore, because cable service devices 114 may utilize preexisting CATV distribution network infrastructure, this granular power quality information may be easily transmitted to a CATV distribution system manager, allowing for information collection at a much faster frequency. Cable service devices as disclosed herein may allow for more accurate management and control of CATV distribution networks, power distribution networks, and/or other systems.

HNT management and control device 116, in accordance with the techniques described herein, may provide an Internet-based geographic information system (GIS) that can offer DSOs & MSOs common capture, storage, analysis and forwarding of power quality information from spatially overlapping serving areas. HNT management and control device 116 contains a Heterogeneous Network Topology Manager that performs the function of a go-between between DSOs and MSOs, who each voluntarily populate the common GIS database with named geographic polygons that reflect their respective serving areas. The geographic go-between function translates power quality information from DSO parlance to MSO parlance and vice versa. In this way, for example, degraded power quality at the corner of 5th Avenue and Main Street observed by the MSO power supply, which may be known as "31A124-PS1", can be communicated to the local DSO in an automated fashion using network identifiers and verbiage familiar to the DSO, such as "Power Pole: Golden_126_Distrib-Phase A".

The nature of GIS systems in use today by DSOs and MSOs is such that exhaustive details on millions of miles of conductor lengths, diameters and attachment points are recorded in great detail. In contrast, by design, HNT management and control device 116 may require only a limited amount of GIS information from DSOs and MSOs, such as the names and the geographic boundaries of their respective individual serving areas.

While described in the example of FIG. 1 as being provided by CATV distribution system manager 108 to HNT management and control device 116, power quality information 115 may additionally or alternatively be used by CATV distribution system manager 108. That is, the cable service devices disclosed herein may be used in conjunction with the HNT management and control devices disclosed herein, or may be used in current CATV distribution networks, without a HNT management and control device. Additionally, while described in the example of FIG. 1 as receiving power quality information 115 from cable service devices 114, HNT management and control device 116 may additionally or alternatively receive such information from other devices within CATV distribution network 110. That is, the HNT management and control devices disclosed herein may be used in conjunction with the cable service devices disclosed herein or may be used with other devices already in use in current CATV distribution networks.

Figure 2:
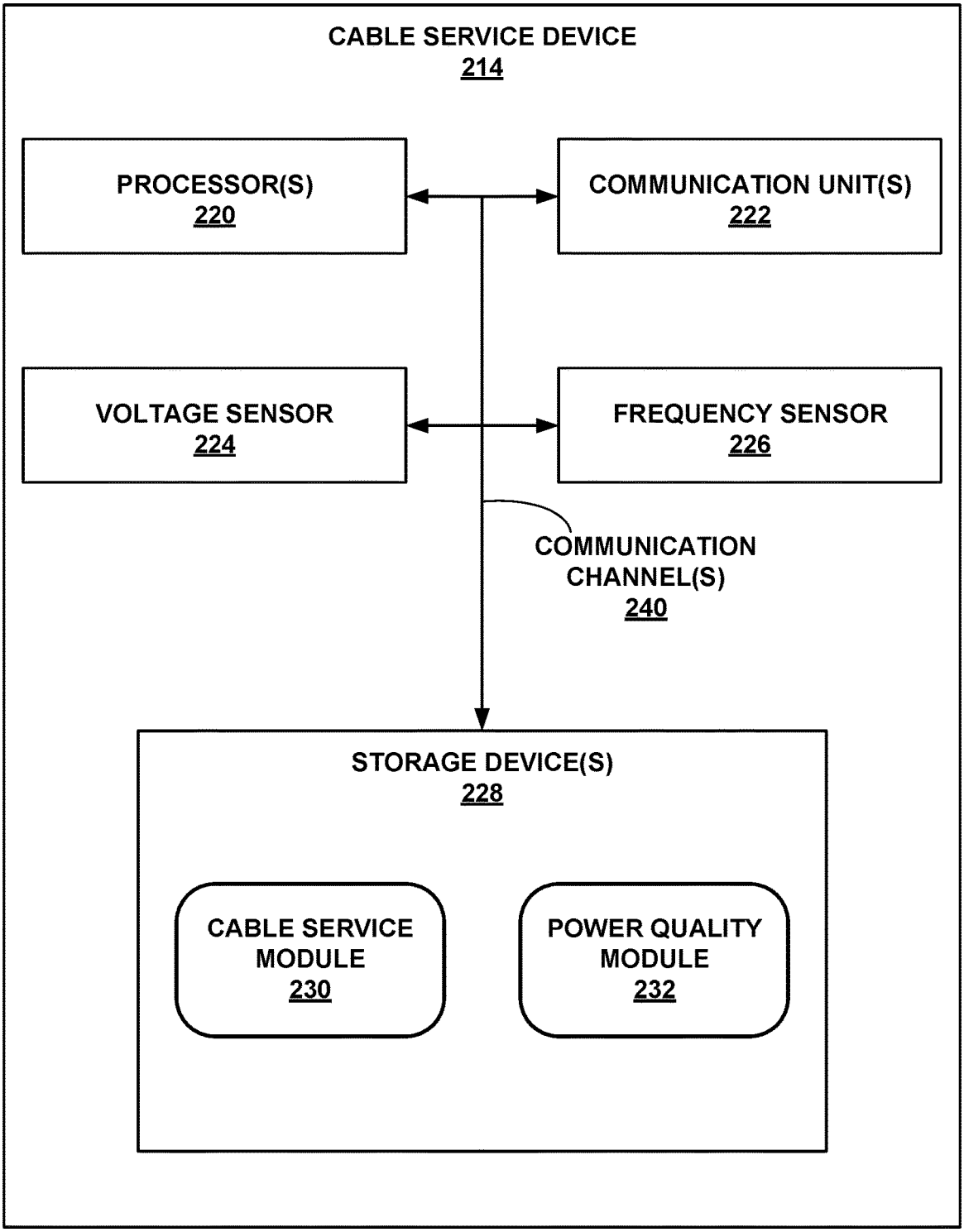
FIG. 2 is a block diagram illustrating an example cable service device configured to measure and provide power distribution network information for HNT management and control, in accordance with one or more aspects of the present disclosure.

FIG. 2 is a block diagram illustrating an example cable service device (cable service device 214) configured to measure and provide power distribution network information for HNT management and control, in accordance with one or more aspects of the present disclosure. The example of FIG. 2 is described below within the context of FIG. 1. For instance, Cable service device 214 may represent one or more of cable service devices 114 described with respect to FIG. 1.

FIG. 2 illustrates only one particular example of a cable service device configured in accordance with the techniques described herein. Other examples of a cable service device may be used in other instances. In some examples, cable service devices may include fewer components than shown in the example of FIG. 2 or may include additional or different components not shown in the example of FIG. 2.

In the example of FIG. 2, cable service device 214 includes one or more processors (processors 220), one or more communications units (communications units 222) and one or more storage devices (storage devices 228). Cable service device 214 also includes voltage sensor 224 and frequency sensor 226. Storage devices 228 of cable service device 214 include cable service module 230 and power quality module 232. Communications channels 240 may interconnect each of components 220, 222, 224, 226, 228, 230, and 232 for inter-component communications (physically, communicatively, and/or operatively). In some examples, communication channels 240 may include a system bus, a network connection, an inter-process communication data structure, or any other method for communicating data.

Communication units 222 may allow cable service device 214 to communicate with external devices via one or more networks by transmitting and/or receiving network signals on the one or more networks. For example, cable service device 214 may use communication units 222 to transmit and/or receive radio frequency signals carrying cable television programming, internet data, VoIP data, or other data via CATV distribution network 110. In some examples, communication units 222 may be configured to communicate via a wired network (e.g., using coaxial cable common to CATV distribution networks). In some examples, communications units 222 may be configured to communicate via one or more wireless networks. Examples of communication units 222 include a tuner, a modulator/demodulator (modem), a diplex filter, a communications processor, buffer memory, a network interface controller (e.g., an Ethernet card), an optical transceiver, a radio frequency transceiver, a GPS receiver, or any other type of device that can send and/or receive information. Additional examples of communication units 222 may include Bluetooth®, GPS, 3G, 4G, and Wi-Fi® radios, or Universal Serial Bus (USB) controllers.

Voltage sensor 224 and frequency sensor 226 may be devices configured to measure electrical voltage and alternating current electrical frequency, respectively. As one example, voltage sensor 224 and frequency sensor 226 may be connected to a power source (not shown) for cable service device 214. Thus, voltage sensor 224 and frequency sensor 226 may measure the voltage and frequency of the power received by cable service device 214, which may be representative of power distribution network 106 at the location of the consumer or consumers with whom cable service device 214 is associated.

While illustrated as internal components of cable service device 214, voltage sensor 224, frequency sensor 226, and or other components may, in some examples, represent external components that share a data path with other components of cable service device 214. For instance, in one example, voltage sensor 224 and frequency sensor 226 may be an external component located outside of and physically separated from a packaging of cable service device 214 but connected to cable service device 214 via wired or wireless communication means. In such example, voltage sensor 224 and frequency sensor 226 may be configured to measure voltage and frequency at another location corresponding to the consumer, such as where power distribution network 106 connects to the consumer's physical location.

Storage devices 228 may store information for processing during operation of cable service device 214. In some examples, storage devices 228 represent temporary memory, meaning that a primary purpose of storage devices 228 is not long-term storage. In some examples, storage devices 228 may be configured for short-term storage of information as volatile memory and therefore may not retain stored contents when powered off. Examples of volatile memories include random access memories (RAM), dynamic random access memories (DRAM), static random access memories (SRAM), and other forms of volatile memories known in the art.

In some examples, storage devices 228 may include one or more computer-readable storage media. That is, storage devices 228 may, in some examples, be configured to store larger amounts of information than volatile memory. Storage devices 228 may further be configured for long-term storage of information as non-volatile memory space and thus may retain information even when powered off. Examples of non-volatile memories include magnetic hard discs, optical discs, floppy discs, flash memories, or forms of electrically programmable memories (EPROM) or electrically erasable and programmable (EEPROM) memories. Storage devices 228 may store program instructions and/or data associated with cable service module 230 and/or power quality module 232.

One or more of processors 220 may implement functionality and/or execute instructions within cable service device 214. For example, processors 220 of cable service device 214 may receive and execute instructions stored by storage devices 228, thereby enabling the functionality of cable service module 230 and/or power quality module 232. In some examples, the execution of these instructions, by processors 220, may cause cable service device 214 to store information within storage devices 228 during program execution. Cable service module 230 and power quality module 232 may be operable by processors 220 to perform various actions, including providing cable service(s) and determining values of power quality attributes.

In accordance with aspects of the present disclosure, cable service module 230 may include instructions that are executable by processors 220 to cause cable service device 214 to provide one or more cable services to a consumer. Cable services may include internet connectivity, delivery of television programming, VoIP services, or any other cable services.

Power quality module 232 may include instructions that are executable by processors 220 to cause cable service device 214 to determine one or more values for power quality attributes. For example, processors 220 may obtain information from voltage sensor 224 to determine a voltage value. Processors 220 may also obtain information from frequency sensor 226 to determine a frequency value. Power quality module 232 may further include instructions that, when executed, cause cable service device 214 to output the determined power quality information. That is, cable service device 214 may output the determined voltage value and determined frequency value (e.g., using communication units 222). In the example of FIG. 1, cable service device 214 may output the determined voltage value and determined frequency value, using the existing infrastructure of CATV distribution network 210, to CATV distribution system manager 208 as part of power quality information 115.

In some examples, cable service device 214 may be configured to determine and output voltage values, frequency values, and/or other power quality attribute values on a periodic basis. For instance, cable service device 214 may determine and output such information every 30 seconds, every minute, every 5 minutes, or at any other frequency. In some examples, cable service device 214 may determine power quality attribute values on a periodic basis but only output such information when various criteria have been met. For instance, power quality module 232 may include instructions that, when executed, cause cable service device 214 to compare determined values to certain threshold values to ascertain whether the determined values are "acceptable." Such threshold values may be static (e.g., preprogrammed into cable service device 214), controlled (e.g., periodically programmed into cable service device 214 directly or remotely), and/or dynamic (e.g., rolling average values or otherwise learned based on historical determined values).

In some examples, cable service device 214 may be configured to generate inferred information based on the determined voltage values, frequency values, and/or other power quality attribute values. For instance, power quality module 232 may include instructions that, when executed, cause cable service device 214 to monitor the determined voltage and frequency value over time and determine, based on the determined voltage and frequency values, whether the values indicate that a fault has occurred. The instructions may further cause cable service device 214 to output such inferred information in addition to or alternative to the "raw" or measured values.

In some examples, cable service device 214 may be configured to determine and/or output power quality parameter values and/or inferred information in response to receiving instructions to do so. In some examples, cable service device 214 may be configured additionally or alternatively to determine and/or output power quality parameter values and/or inferred information on its own. In other words, cable service device 214 may be configured to provide poll data (e.g., when polled by a CATV distribution system manager or other device or entity) and/or trap data (e.g., generated at regular intervals and/or when specified criteria are met).

By determining and outputting voltage values, frequency values, and/or other power quality attribute values, cable service device 214 may allow CATV distribution system managers to better understand and account for variabilities in a geographically overlapping power distribution network. As further described herein, cable service devices as disclosed herein may also allow power distribution system managers to have significantly more insight into power distribution network operation (e.g., via a HNT management and control device) and thus may improve management and control of such power distribution networks, as well. In addition, cable service devices such as cable service device 214 may allow for such improved management and control with only a small increase in device cost and without the need for additional distribution network infrastructure.

Figure 3:
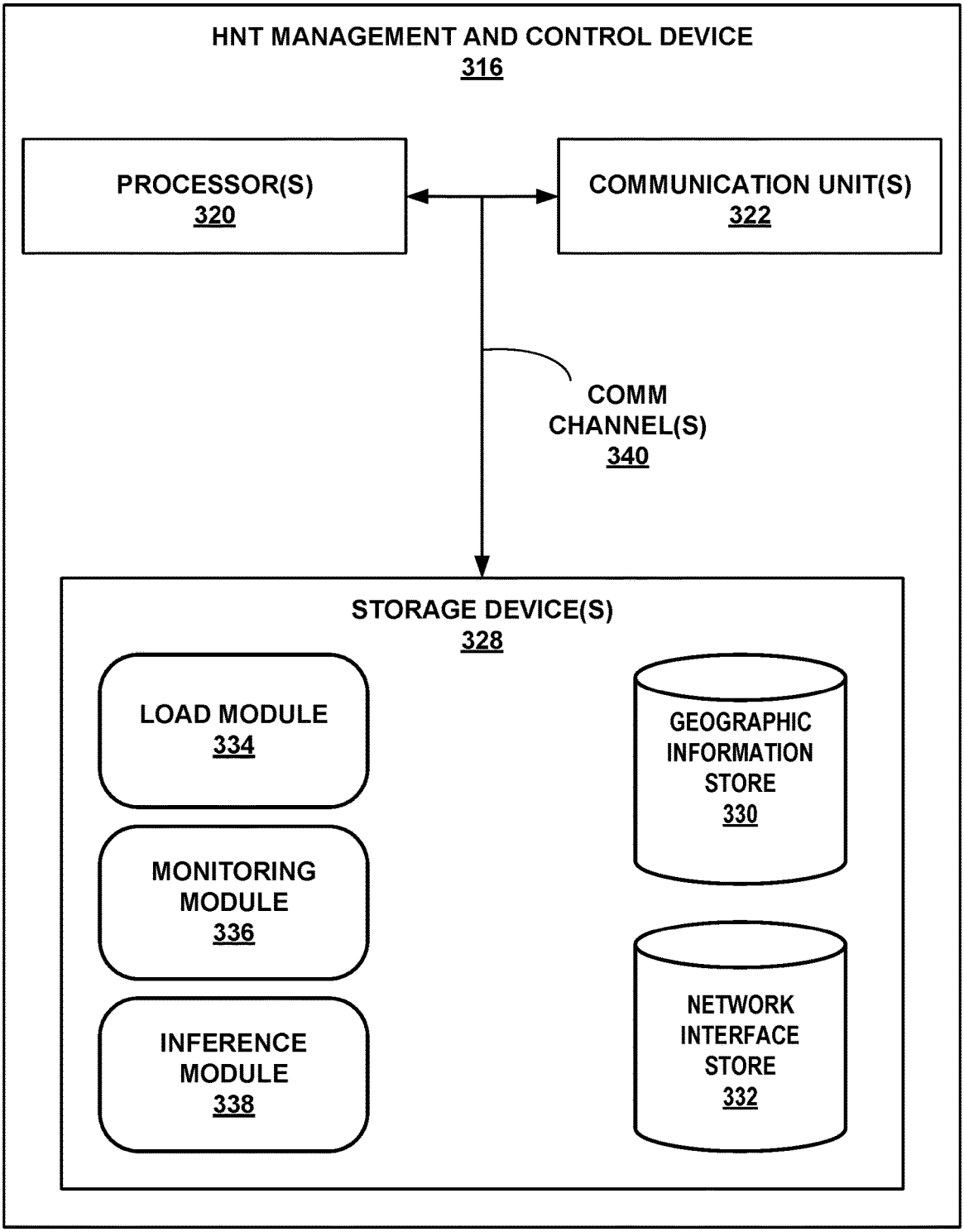
FIG. 3 is a block diagram illustrating an example HNT management and control device configured to manage and control two or more networks having heterogenous topology, in accordance with one or more aspects of the present disclosure.

FIG. 3 is a block diagram illustrating an example HNT management and control device (HNT management and control device 316) configured to manage and control two or more networks having heterogenous topology, in accordance with one or more aspects of the present disclosure. The example of FIG. 3 is described below within the context of FIG. 1. For instance, HNT management and control device 316 may represent HNT management and control device 116 described with respect to FIG. 1.

FIG. 3 illustrates only one particular example of a HNT management and control device configured in accordance with the techniques described herein. Other examples of a HNT management and control device may be used in other instances. In some examples, HNT management and control devices may include fewer components than shown in the example of FIG. 3 or may include additional or different components not shown in the example of FIG. 3.

In the example of FIG. 3, HNT management and control device 316 includes one or more processors (processors 320), one or more communications units (communications units 322) and one or more storage devices (storage devices 328). Storage devices 328 of HNT management and control device 316 include geographic information store 330, network interface store 332, load module 334, monitoring module 336, and inference module 338. Communications channels 340 may interconnect each of components 320, 322, 328, 330, 332, 334, 336, and 338 for inter-component communications (physically, communicatively, and/or operatively). In some examples, communication channels 340 may include a system bus, a network connection, an inter-process communication data structure, or any other method for communicating data.

While illustrated as internal components of HNT management and control device 316, one or more components may, in some examples, represent external components that share a data path with other components of HNT management and control device 316. For instance, in one example, modules 334, 336, and/or 338 may be external components stored in storage devices 328 that are located outside of and physically separated from a packaging of HNT management and control device 316 but connected to HNT management and control device 316 and to one another via wired or wireless communication means, such as in a cloud computing environment.

Communication units 322 may allow HNT management and control device 316 to communicate with external devices via one or more networks by transmitting and/or receiving network signals on the one or more networks. For example, HNT management and control device 316 may use communication units 322 to transmit and/or receive digital data via a physical network, such as Ethernet. As another example, HNT management and control device 316 may use communication units 322 to transmit and/or receive radio signals on a radio network such as a cellular radio network. Likewise, communication units 322 may transmit and/or receive satellite signals on a satellite network such as a GPS network. Examples of communication units 322 include a network interface controller (e.g., an Ethernet card), an optical transceiver, a radio frequency transceiver, a GPS receiver, or any other type of device that can send and/or receive information. Other examples of communication units 42 may include Bluetooth®, GPS, 3G, 4G, and Wi-Fi® radios, as well as Universal Serial Bus (USB) controllers.

Storage devices 328 may store information for processing during operation of HNT management and control device 316. In some examples, storage devices 328 represent temporary memory, meaning that a primary purpose of storage devices 328 is not long-term storage. In some examples, storage devices 328 may be configured for short-term storage of information as volatile memory and therefore may not retain stored contents when powered off. Examples of volatile memories include random access memories (RAM), dynamic random access memories (DRAM), static random access memories (SRAM), and other forms of volatile memories known in the art.

In some examples, storage devices 328 may include one or more computer-readable storage media. That is, storage devices 328 may, in some examples, be configured to store larger amounts of information than volatile memory. Storage devices 328 may further be configured for long-term storage of information as non-volatile memory space and thus may retain information even when powered off. Examples of non-volatile memories include magnetic hard discs, optical discs, floppy discs, flash memories, or forms of electrically programmable memories (EPROM) or electrically erasable and programmable (EEPROM) memories. Storage devices 328 may store program instructions and/or data associated with geographic information store 330, network interface store 332, load module 334, monitoring module 336, and/or inference module 338.

One or more of processors 320 may implement functionality and/or execute instructions within HNT management and control device 316. For example, processors 320 of HNT management and control device 316 may receive and execute instructions stored by storage devices 328, thereby enabling the functionality of load module 334, monitoring module 336, and/or inference module 338. In some examples, the execution of these instructions, by processors 320, may cause HNT management and control device 316 to store information within storage devices 328 during program execution. load module 334, monitoring module 336, and/or inference module 338 may be operable by processors 320 to perform various actions, including determining geographic overlap between distribution networks having heterogenous topology, and allowing such distribution networks to be managed and/or controlled based additionally on information from overlapping distribution networks.

In accordance with aspects of the present disclosure, load module 334 may contain instructions executable by processors 320 to allow HNT management and control device 316 to receive indications of geographic areas of multiple distribution networks. Indications of geographic areas may include a unique name, and latitude/longitude coordinates of a land shape polygons (e.g., specifying a serving area). In some examples, the indications of geographic areas may also include names of network elements providing services to polygon serving areas. Load module 334 may also be executable to determine, using geographic information store 330, whether or not the distribution networks geographically overlap. For any overlapping areas, load module 334 may be executable to generate communication interfaces for such overlapping areas. Communication interfaces may be stored in network interface store 332.

As one specific example, communications units 324 of HNT management and control device 316 may receive (e.g., from power distribution system manager 104) an indication of a first geographic area corresponding to the portion of power distribution network 106 that includes consumers 112. Load module 334 may be executable by processors 320 to receive the indication and store the geographic information in geographic information store 330. The indication of the first geographic area may be latitude and longitude coordinates indicating a center point and length of a radius around that center point, polygons described with northing and easting values, coordinates of hexagonal polygons, boundaries of regularly and irregularly shaped polygons, or another other way of indicating a geographic area. Load module 334 may also be executable by processors 320 to receive (e.g., from CATV distribution system manager 108) an indication of a second geographic area corresponding to the portion of CATV distribution network that includes consumers 112.

Load module 334 may be executable to compare the indicated second geographic area to other geographic areas in geographic information store 330 to determine whether the second geographic area overlaps with any other geographic areas. For example, load module 334 may determine a number of points around the defined edge of the second geographic area. In various examples, load module 334 may determine 3 points, 5 points, 10 points, or any other number of points that sufficiently approximates the boundary of the second geographic area. In some examples, such as when a geographic area is received as a set of geographic coordinates defining vertices of a polygon, load module may not need to determine such points and may instead use the provided points. Regardless, load module 334 may mathematically determine whether any of these points fall within any of the previously received geographic areas to determine whether the second geographic area overlaps with any other geographic area.

In some examples, load module 334 may be executable by processors 320 to receive one or more schemas corresponding to each geographic area. Each schema may define a logical/syntactical structure for sending data to and/or receiving data from the distribution system manager for the geographic area. That is, the schema may define how the distribution system manager's data is structured, so that HNT management and control device 316 can properly interpret data received from the distribution system manager and structure data (e.g., data received from other distribution system managers and/or data generated by HNT management and control device 316) to be sent to the distribution system manager.

Load module 334 may be executable to determine that the first geographic area and the second geographic area overlap and consequently generate a communication interface for power distribution network 106 and CATV distribution network 110 in the overlapping geographic area (e.g., the area including consumers 112).

A communication interface may be any logical architecture usable to translate data received from one distribution network to data interpretable by another distribution network. One example of a communication interface may be an application programming interface (API). The API may be created using software routines and communications protocols that are understood by DSO and MSO GIS systems. For example, load module 334 may utilize received schemas to create the communication interface. In some examples, an operator or manager of HNT management and control device 316 may assist in the creation of the communications interface. In others, load module 334 may generate the communication interface on its own (e.g., using provided information to link schema elements, etc.). The function of the API would be to present a uniform communications interface for translating the observed attribute values in one domain, such as the MSO, to the other domain, such as the DSO. Load module 334 may store generated communication interfaces in network interface store 332.

Load module 334 may receive new and/or updated indications of geographic areas corresponding to power distribution network 106 and CATV distribution network 110 and create and modify communication interfaces between the two as necessary. In some examples, Load module 334 may also be executable by processors to remove communication interfaces, such as when an indication of an updated geographic area means there is no longer an overlap, or when a distribution system manager requests such removal.

In accordance with aspects of the present disclosure, monitoring module 336 may contain instructions executable by processors 320 to allow HNT management and control device 316 to receive information from a first network and determine whether the information is relevant to a second distribution network. If the information is relevant to a second network, monitoring module 336 may also be executable to translate the information into a format interpretable by a manager of the second network. The translated information may then be used for management and control of the second network.

As one specific example, communications units 324 of HNT management and control device 316 may receive (e.g., from CATV distribution system manager 108) one or more power quality parameter values (e.g., included in power quality information 115). Monitoring module 336 may be executable by processors 320 to receive the power quality parameter values and determine whether or not the power quality parameter values are relevant to another distribution network, such as power distribution network 106. Monitoring module 336 may determine whether the values are relevant by checking whether a communication interface exists in network interface store 332 for the location from which the values were obtained.

If a communication interface exists in network interface store 332 for the location to which a power quality parameter value pertains, then monitoring module 336 may be executable to translate, using the communication interface, the received power quality parameter value into a translated parameter value that is interpretable by power distribution system manager 104. If no such communication interface exists in network interface store 332, then monitoring module 336 may take no action or perform other operations.

Monitoring module 336 may be executable to output translated parameter values to the manager for which the parameter values were translated. For instance, monitoring module 336 may transmit (e.g., via communication units 322) translated power quality attribute values to power distribution system manager 104. Power distribution system manager 104 may utilize the translated power quality attribute values to adjust operations of power distribution network 106, such as by causing devices within power distribution network 106 to modify operation. In this way, HNT management and control device 316 may cause at least one device within power distribution network 106 to modify operation based on parameter values obtained by a device within CATV distribution network 110.

In some examples, monitoring module 336 may also be executable to receive parameter values from devices within power distribution network 106, determine whether such parameter values are relevant to CATV distribution network 110, and, if so, translate such values using the applicable communication interface and output such translated parameter values to CATV distribution system manager 108. That is, monitoring module 336 may be executable to provide two-way or even multi-way translation between any number of distribution networks.

In accordance with aspects of the present disclosure, inference module 338 may contain instructions executable by processors 320 to allow HNT management and control device 316 to monitor received parameter values and make inferences about distribution network problems. For example, inference module 338 may receive parameter values from contiguous devices indicating a drop in power quality. Consequently, inference module 338 may determine that the region is having power quality issues. Inference module 338 may output such inferences to various distribution system managers as necessary.

As one specific example, communications units 324 of HNT management and control device 316 may receive (e.g., from CATV distribution system manager 108) power quality parameter values (e.g., included in power quality information 115 received from cable service devices 114A, 114B, and 114C). The power quality parameter values may all indicate a similar problem with power quality at consumers 112A, 112B, an 112C. Inference module 338 may be executable by processors 320 to receive these power quality parameter values.

Inference module 338 may be executable to determine, based on the geographic locations to which the parameter values pertain and the similarity between the parameter values, that a power outage is affecting a portion of power distribution network 106. Consequently, inference module 338 may output an indication of the power outage to managers of potential affected distribution systems. For example, inference module 338 may output (e.g., via communication units 322) an alert message about the inferred power outage to power distribution system manager 104 because power distribution system manager 104 manages power distribution network 106. Inference module 338 may also output an alert message about the inferred power outage to CATV distribution system manager 108, since the CATV distribution system relies on power distribution system 106. In some examples, inference module 338 may also output an alert message to the manager of another power distribution network that is adjacent to power distribution network 106, as the power outage in power distribution network 106 may affect the adjacent power distribution network.

By making inferences based on information from multiple distribution networks, inference module 338 may provide more proactive information to distribution network managers. This may, in turn, allow managers to more appropriately address network problems and prevent additional problems.

An important aspect of HNT management and control devices, as described herein is privacy and security. HNT management and control device 316, for example, may enforce specific privacy-focused rules of engagement (ROE) to dramatically limit and restrict disclosure of power quality readings and other distribution network information, and to protect the confidentiality of distribution managers' GIS information.

The following is one example method for maintaining the privacy and/or security of various distribution system operators using HNT management and control:

1) Upon login to the HNT management and control device, any contributing entity (e.g., MSO, DSO, or other private or public facility or service operator, such as a natural gas or water distributor or a municipal or emergency service operator) can only access (i.e., can only see) (a) what they themselves have submitted as their own land shapes (a.k.a. serving areas) in the GIS system and (b) those matches that exist with land shapes (serving areas) previously submitted by other entities, and 2) Upon any other entity submitting a newly overlapping land shape (serving area), the geographic go-between (i.e., a communication interface) is established, and contributing entities (a) are notified of the match, and (b) automatically start receiving forwarded telemetry readings.

Additional details and description of a HNT management and control device configured in accordance with the techniques of the present disclosure are provided below with respect to FIGS. 3-5.

Figure 4:
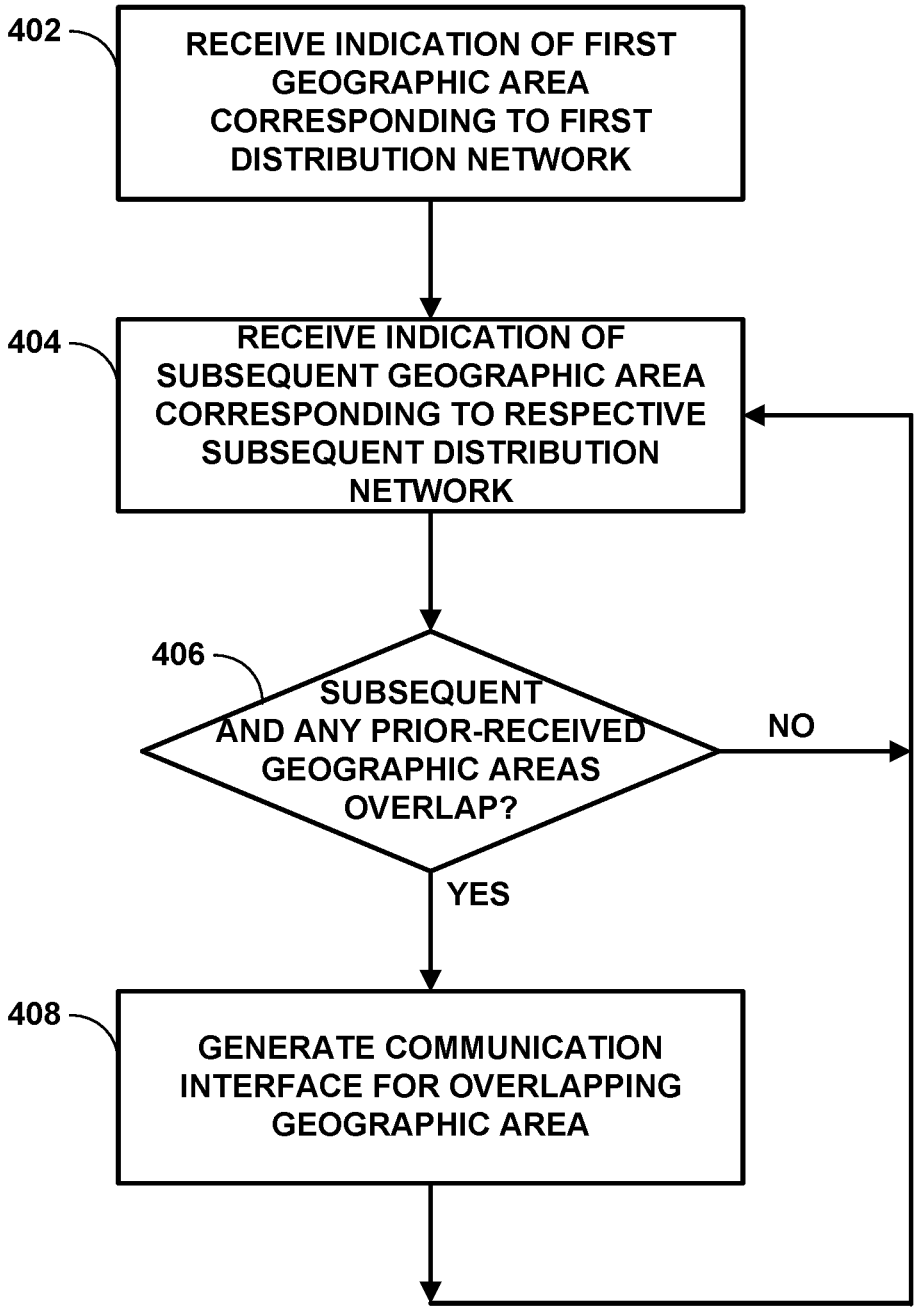
FIG. 4 is a flow diagram illustrating example operations of a HNT management and control device, in accordance with one or more aspects of the present disclosure.

FIG. 4 is a flow diagram illustrating example operations of a HNT management and control device, in accordance with one or more aspects of the present disclosure. For purposes of illustration only, the example operations of FIG. 4 are described below within the context of FIG. 1. For instance, the example operations of FIG. 4 may be performed by HNT management and control device 116. The example operations of FIG. 4 may represent a "load mode" that HNT management and control device 116 may continuously execute to receive information about service areas from various stakeholders and integrate those service areas for common data capture and network management.

In the example of FIG. 4, HNT management and control device 116 may receive an indication of a first geographic area that corresponds to a first distribution network (402). For instance, HNT management and control device 116 may receive information from power distribution system manager 104 identifying an area of power distribution network 106 (e.g., the area including consumers 112A and 112B and telemetry device 107A). HNT management and control device 116 may also receive an indication of a subsequent geographic area that corresponds to a respective subsequent distribution network (402). For instance, HNT management and control device 116 may receive information from CATV distribution system manager 108 identifying the area of CATV distribution network 110 (e.g., the area of cable service device 114A).

In the example of FIG. 4, HNT management and control device 116 may determine whether the subsequent geographic area overlaps with any prior-received geographic areas (406). For instance, HNT management and control device 116 may determine whether the first geographic area and the subsequent geographic area overlap.

In the example of FIG. 4, if HNT management and control device 116 determines that the subsequent geographic area does not overlap with any prior-received geographic areas ("NO" branch of operation 406), HNT management and control device 116 may store the received subsequent geographic area and wait to receive another indication of a respective geographic area. In some examples, (such as when HNT management and control device 116 determines that the second geographic area overlaps with another geographic area) HNT management and control device 116 may perform one or more other operations or not perform any further operations.

In the example of FIG. 4, if HNT management and control device 116 determines that the subsequent geographic area does overlap with a prior-received geographic area ("YES" branch of operation 406), HNT management and control device 116 may generate a communication interface for the overlapping geographic area (408). For instance, because the area received from CATV distribution system manager 108 overlaps with the geographic area received from power distribution system manager 104, HNT management and control device 116 may generate an API usable to translate power quality parameter values determined by cable service device 114A and received from CATV distribution system manager 108 into power quality parameter values interpretable by power distribution system manager 104 and vice versa. In other words, communication interfaces generated by HNT management and control device 116 may translate data from the schema of a first distribution system manager to the schema of a second distribution system manager, thereby facilitating the easy exchange and collation of information between systems.

As shown in the example of FIG. 4, HNT management and control device 116 may continuously wait to receive additional indications of respective geographic areas. As each new geographic area is received, HNT management and control device 116 may determine whether the newly-received geographic area overlaps with any previously received geographic areas and, if so, create communications interfaces accordingly.

The example operations of FIG. 4 may additionally or alternatively be described by the following example pseudocode:

```
Start Load Mode
In the presence of a newly entered polygon for a DSO or MSO
serving area:
    a) If an overlap is identified with an existing polygon in GIS
    database,
        i) Notify all entities (e.g., DSO, MSO, etc.) of the
        match, and
        ii) Create a going forward "always active" application
        programming interface (API) for 2-way communication of:
            1) Telemetry Readings,
            2) Telemetry Queries,
            3) Telemetry Responses, and
            4) Spontaneous Messages (e.g., inference of power
            quality issue),
    b) Else
        i) Save the new serving area in GIS database and confirm
        submission
        ii) In anticipation of the arrival of a serving area
        match in the future, arm a notification trigger that will
        fire as soon as overlapping areas are detected.
End Load Mode
```

Figure 5:
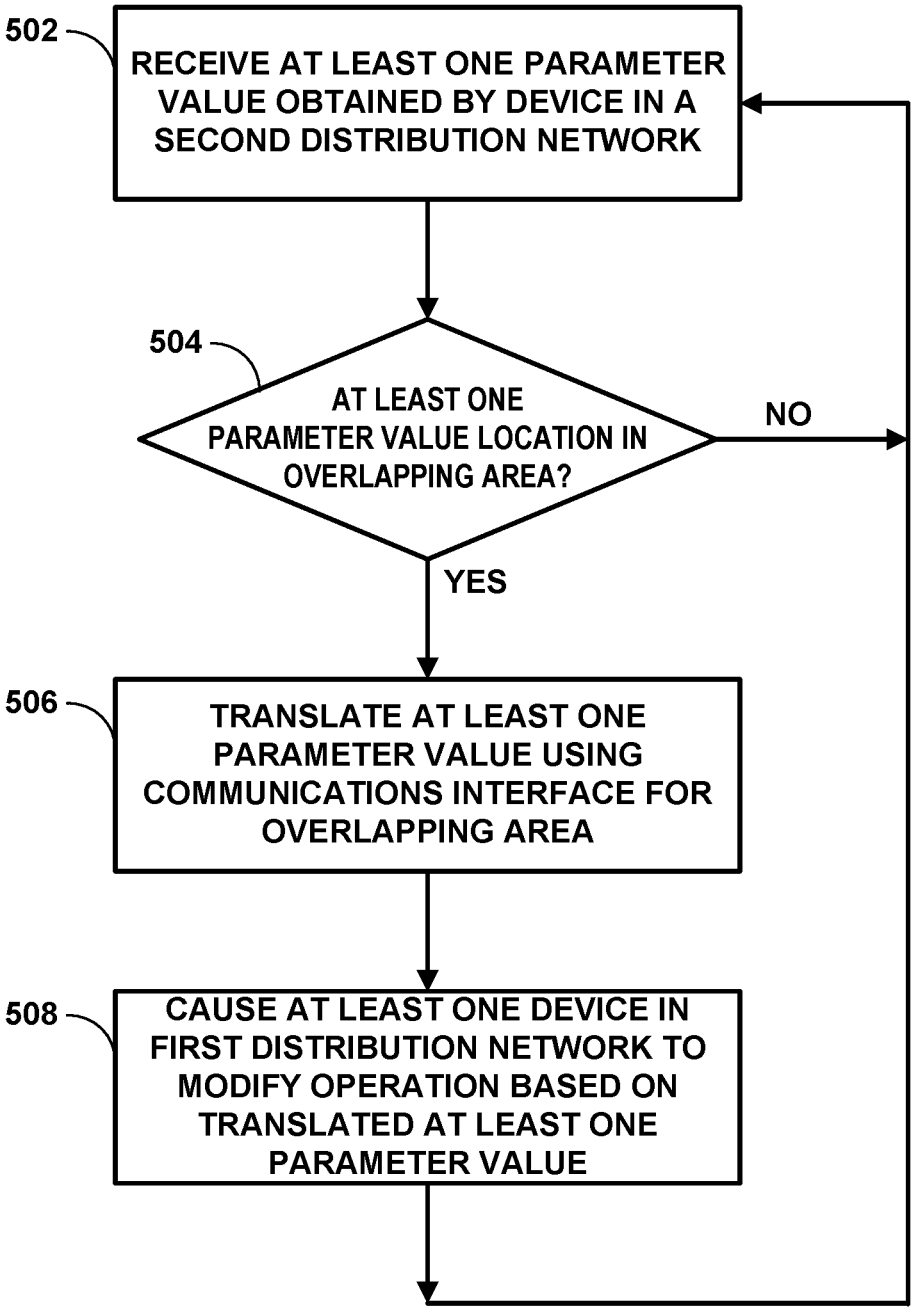
FIG. 5 is a flow diagram illustrating example operations of a HNT management and control device, in accordance with one or more aspects of the present disclosure.

FIG. 5 is a flow diagram illustrating example operations of a HNT management and control device, in accordance with one or more aspects of the present disclosure. For purposes of illustration only, the example operations of FIG. 5 are described below within the context of FIG. 1. For instance, the example operations of FIG. 5 may be performed by HNT management and control device 116. The example operations of FIG. 5 may represent a "run1 mode" that HNT management and control device 116 may continuously execute to receive network information (e.g., power quality parameter values) from various stakeholders and provide such information to other relevant parties.

In the example of FIG. 5, HNT management and control device 116 may receive at least one parameter value obtained by a device in a second distribution network (502). For instance, HNT management and control device 116 may receive power quality parameter values, determined by cable service device 112A, from CATV distribution system manager 108. The received power quality parameter values may be structured and formatted according to a schema used by CATV distribution system manager 108.

In the example of FIG. 5, HNT management and control device 116 may determine whether the at least one parameter value is from a geographic area that overlaps with other geographic areas received by HNT management and control device 116 (504). For instance, HNT management and control device 116 may determine whether the geographic location of cable service device 114A overlaps with any other geographic areas received (including the geographic area received from power distribution system manager 104). In some examples, HNT management and control device 116 may determine this based on geographic information received in conjunction with the at least one parameter value.

In the example of FIG. 5, if HNT management and control device 116 determines that the at least one parameter value is not from a geographic area that overlaps with other received geographic areas ("NO" branch of operation 504), HNT management and control device 116 may take no action or perform one or more other actions. If HNT management and control device 116 determines that the at least one parameter value is from a geographic area that overlaps with other received geographic areas ("YES" branch of operation 504), HNT management and control device 116 may translate the at least one parameter value using a communications interface for the overlapping area (506). For instance, HNT management and control device 116 may use the API to convert the power quality parameter values from the schema used by CATV distribution system manager 108 to the schema used by power distribution system manager 104.

In the example of FIG. 5, HNT management and control device 116 may cause at least one device in the first distribution network to modify operation based on the translated at least one parameter value (508). For instance, HNT management and control device 116 may output the converted power quality parameter values to power distribution system manager 104 and power distribution system manager 104 may modify operation of devices within power distribution network 106 based on the received power quality parameter values.

In various examples, HNT management and control device 116 may convert and/or output different amounts and/or types of information in run1 mode. For instance, in some examples HNT management and control device 116 may always convert and output the literal received parameter values to managers of any overlapping area. In some examples, HNT management and control device 116 may determine a difference between the received parameter value and a previously received parameter value and output a difference value to managers of any overlapping area. This may be useful when there are limited communication means or in order to reduce the amount of data transferred. In some examples, HNT management and control device 116 may determine whether the received parameter value surpasses a particular threshold and may only convert and output the parameter value if it surpasses the threshold. This may be useful to reduce the amount of data transferred, as managers only get information if there is a problem.

The example operations of FIG. 5 may additionally or alternatively be described by the following example pseudocode:

```
Start Run1 Mode
In the presence of a new telemetry message on either side of an
existing API between DSO and MSO serving areas:
    a) Forward the message via an API from the DSO to the MSO,
    or vice-versa, in appropriate parlance using either,
        i) Verbose submode: containing all observations in their
        entirety,
        ii) Delta submode: containing only the delta value of the
        current or observation minus the prior observation, or
        iii) Exception submode: containing only observations
        determined to be out of tolerance, such as, for example,
            1) Percentage change > +-5% from prior
            observation(s), or
            2) Observation is outside fixed lower and upper
            limits of 114 VAC and 126 VAC.
End Run1 Mode
```

Figure 6:
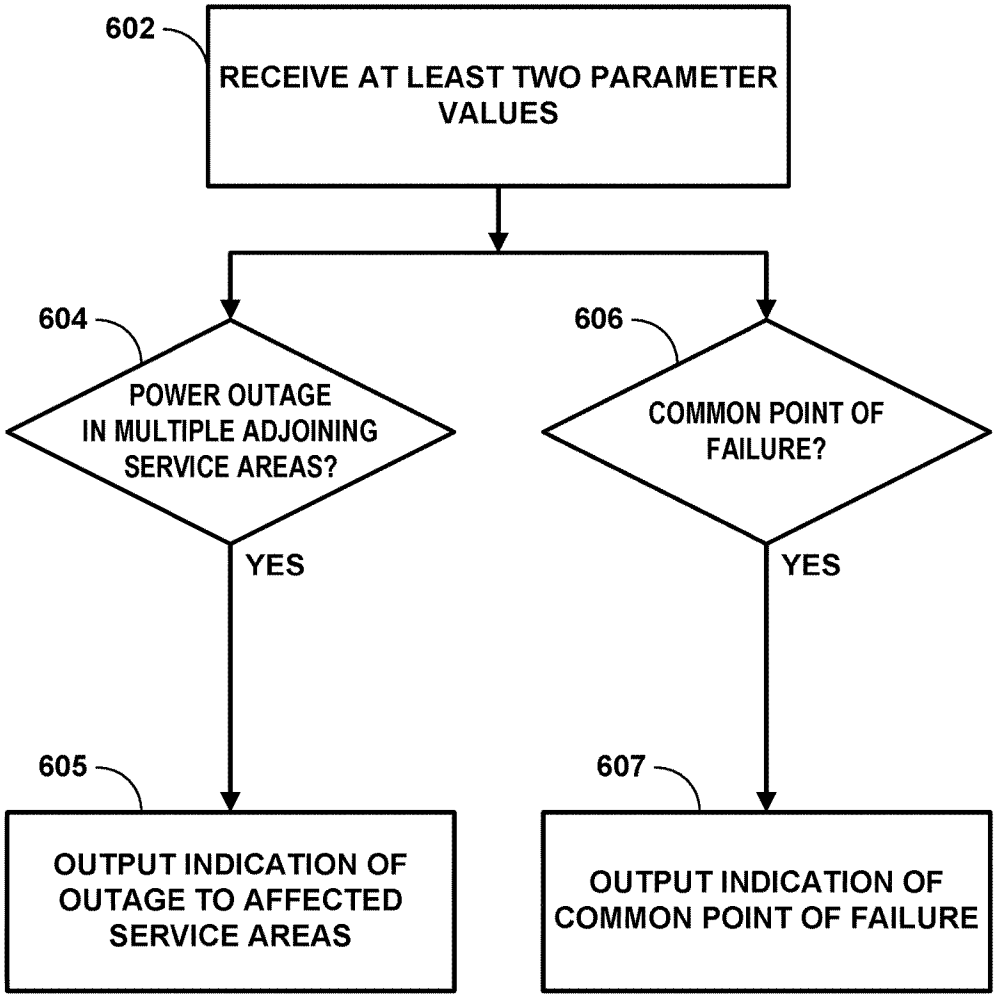
FIG. 6 is a flow diagram illustrating example operations of a HNT management and control device, in accordance with one or more aspects of the present disclosure.

FIG. 6 is a flow diagram illustrating example operations of a HNT management and control device, in accordance with one or more aspects of the present disclosure. For purposes of illustration only, the example operations of FIG. 6 are described below within the context of FIG. 1. For instance, the example operations of FIG. 5 may be performed by HNT management and control device 116. The example operations of FIG. 5 may represent a "run2 mode" that HNT management and control device 116 may continuously execute to predictively generate inferences based on received network information (e.g., power quality parameter values) and provide such inferences to relevant parties.

In the example of FIG. 6, HNT management and control device 116 may receive at least two parameter values (602). The received parameter values may be from the same distribution system manager or from different distribution system managers. The received parameter values may be about the same network or may be about different networks.

HNT management and control device 116 may, in the example of FIG. 6, determine, based on the at least two parameter values, whether there is a power outage in multiple adjoining service areas (604). For instance, if two or more parameter values indicate a power outage, HNT management and control device 116 may compare the geographic locations corresponding to the received parameter values. The more parameter values received in a particular location that indicate a power outage, the more likely it is that there is a power outage in that area. Thus, HNT management and control device 116 may determine whether or not there is a power outage, as well as a confidence level for the power outage inference, based on the the geographic locations and power quality parameter values received.

In the example of FIG. 6, responsive to determining there is a power outage in multiple adjoining service areas ("YES" branch of operation 604), HNT management and control device 116 may output an indication of outage to affected service areas (605). For instance, HNT management and control device 116 may output indications to each manager having a geographic area overlapping with at least one of the locations from which parameter values were received and used to generate the inference. In some examples, the outputted indications may include confidence level information based on the certainty of the inferred power outage. For example, if only two locations caused the inference, then the confidence level may be relatively lower. If five to ten locations caused the inference, then the confidence level may be relatively moderate. If over ten locations caused the inference, then the confidence level may be relatively high.

In the example of FIG. 6, HNT management and control device 116 may determine, based on the at least two parameter values, whether there is a common point of failure (606). For example, when two or more received parameter values indicate a power outage or other issue, HNT management and control device 116 may use the locations corresponding to the two parameter values to infer whether there is a likely connection between them.

In the example of FIG. 6, responsive to determining that there is a common point of failure ("YES" branch of operation 606), HNT management and control device 116 may output an indication of the common point of failure (607). For instance, HNT management and control device 116 may output the indication to managers having areas that overlap with each of the locations corresponding to the two parameter values, as well as to managers having areas that overlap with the inferred common point of failure.

In the example of FIG. 6, HNT management and control device 116 may, based on the at least two parameter values, determine other important inferences, such as _____. If such inferences are determined, HNT management and control device 116 may output information to relevant managers accordingly.

The example operations of FIG. 6 may additionally or alternatively be described by the following example pseudocode:

```
Start Run2 Mode
While performing continuous review of power quality issues within
overlapping shapes (serving areas):
    a) If an inference can be made as to contiguous failures, for
    example, multiple adjoining service areas have a power outage
    or have power quality issue (s),
        i) Create and send a spontaneous message to overlapping
        entities listing all affected service areas using a
        parlance suitable for each, or
    b) If an inference can be made as to common point of failure
    (including but not limited to customer triplex drop, DSO
    transformer, DSO Capacitor Bank, MSO power supply, etc.),
        i) Create and send a spontaneous message to overlapping
        entities listing suspected common point of failure,
        summary and raw supporting telemetry readings, or
    c) If any other valuable inference can be made,
        i) Create and send a spontaneous message to overlapping
        entities listing appropriate information.
End Run2 Mode
```

By allowing for common capture and distribution of distribution network information, the operations described in FIGS. 4-6 may enable distribution system managers to greatly increase the amount of information available for management and control of their networks. Furthermore, by providing spontaneous inferences, the operations of FIG. 6 may allow for more intelligent control of all distribution networks involved.

The techniques of the present disclosure may additionally or alternatively be described by one or more of the following examples:

Example 1

A system comprising: at least one cable service device comprising a processor and a voltage sensor, wherein: the at least one cable service device corresponds to a respective at least one power consumption location that is connected to a power distribution network, and the at least one cable service device is configured to: provide at least one cable service to the power consumption location via a cable television (CATV) distribution network; determine a voltage value representing a voltage of the power distribution network at the at least one power consumption location; and output the voltage value; a heterogenous network topology management and control (HNTMC) device comprising a processor and configured to: receive an indication of the voltage value; and cause at least one device within the power distribution network to modify operation based on the voltage value.

Example 2

The system of example 1, wherein: the at least one cable service device is further configured to: determine a frequency value representing a frequency of the power distribution network at the at least one power consumption location; and output the frequency value, and the HNTMC device is further configured to: receive an indication of the frequency value; and cause the at least one device within the power distribution network to modify operation based further on the frequency value.

Example 3

The system of any of examples 1-2, wherein: the cable service device comprises one of: a cable modem, a cable set-top box, or multimedia terminal adapter (MTA), and the at least one cable service comprises at least one of television programming, internet connectivity, or voice over IP (VoIP) services.

Example 4

The system of any of example 1-3, wherein the HNTMC device is further configured to: receive at least one of a second voltage value representing a voltage of the power distribution network at a second location, the second location being different from the at least one power consumption location or a frequency value representing a frequency of the power distribution network at the second location from a power distribution device; and cause the at least one device within the power distribution network to modify operation based further on the at least one of the second voltage value or the frequency value.

Example 5

The system of any of example 1-4, wherein: the HNTMC device is further configured to: receive an indication of a first geographic area corresponding to a first distribution network; receive an indication of a second geographic area corresponding to a second distribution network; and determine, based on the first geographic area and the second geographic area, that at least a portion of the first distribution network and at least a portion of the second distribution network overlap in an overlapping geographic area; and causing the at least one device within the power distribution network to modify operation comprises: determining whether the at least one power consumption location is within the overlapping geographic area; and responsive to determining that the at least one power consumption location is within the overlapping geographic area: converting the voltage value to a converted voltage value that is understandable by a power distribution network management system; and outputting the converted voltage value.

Example 6

The system of example 5, wherein: the HNTMC device is further configured to generate, responsive to determining that at least a portion of the first distribution network and at least a portion of the second distribution network overlap, a communication interface that converts power quality parameter information between a first schema that is interpretable by a manager of the first distribution network and a second schema that is interpretable by a manager of the second distribution network, and converting the voltage value comprises converting the voltage value using the communication interface.

Example 7

The system of any of example 1-6, wherein causing the at least one device within the power distribution network to modify operation comprises: determining a difference between the voltage value and a previously received voltage value, and outputting an indication of the difference.

Example 8

A device comprising: a voltage sensor configured to measure a voltage value that represents a voltage of a power distribution network at a power consumption location that corresponds to the device; at least one processor communicatively coupled to the voltage sensor, the at least one processor configured to: provide at least one cable service to the power consumption location via a cable television (CATV) distribution network; and output an indication the voltage value.

Example 9

The device of example 8, further comprising: a frequency sensor configured to measure a frequency value that represents a frequency of the power distribution network at the power consumption location, wherein the at least one processor is further configured to output the frequency value.

Example 10

The device of any of examples 8-9, wherein the at least one processor is configured to output the indication of the voltage value via the CATV distribution network.

Example 11

The device of example 8, wherein outputting an indication of the voltage value comprises: determining whether the voltage value exceeds a threshold value that represents either a specified minimum voltage or a specified maximum voltage; and responsive to determining that the voltage value exceeds the threshold value, outputting the indication of the voltage value.

Example 12

A device comprising: at least one processor configured to: receive an indication of a first geographic area corresponding to a first distribution network; receive an indication of a second geographic area corresponding to a second distribution network; determine, based on the first geographic area and the second geographic area, that at least a portion of the first distribution network and at least a portion of the second distribution network overlap in an overlapping geographic area; receive at least one parameter value obtained by a device within the second distribution network, the at least one parameter value corresponding to a location within the overlapping geographic area; and cause at least one device within the first distribution network to modify operation based on the at least one parameter value of the second distribution network.

Example 13

The device of example 12, wherein the first distribution network comprises a power distribution network and wherein the second distribution network comprises a cable television (CATV) distribution network.

Example 14

The device of any of examples 12-13, wherein the at least one parameter value comprises at least one second network parameter value and wherein the at least one processor is further configured to: receive at least one first network parameter value of the first distribution network, the at least one first network parameter value corresponding to a location within the overlapping geographic area; and cause at least one device within the second distribution network to modify operation based on the at least one first network parameter value of the first distribution network.

Example 15

The device of any of examples 12-14, wherein the at least one processor is further configured to: responsive to determining that the at least a portion of the first distribution network and the at least a portion of the second distribution network overlap, generate a communication interface for the overlapping geographic area, wherein the communication interface translates parameter values received from the second network into translated parameter values that are interpretable by a distribution network management system of the first distribution network.

Example 16

The device of example 15, wherein causing the at least one device within the first distribution network to modify operation comprises: translating, using the communication interface for the overlapping geographic area, the at least one parameter value into at least one translated parameter value; and outputting, to the distribution network management system, the at least one translated parameter value.

Example 17

The device of any of examples 15-16, wherein causing the at least one device within the first network to modify operation comprises: determining whether or not the at least one parameter value exceeds a threshold; responsive to determining that the at least one parameter value exceeds the threshold, translating, using the communication interface for the overlapping geographic area, the at least one parameter value into at least one translated parameter value; and outputting, to the distribution network management system, the at least one translated parameter value Example 18

The device of example 17, wherein the threshold comprises at least one of: a value representing a maximum allowable limit; a value representing a minimum allowable limit; or a value representing a maximum deviation from a previous parameter value.

Example 19

The device of any of examples 15-18, wherein: the first distribution network comprises a power distribution network, the at least one parameter value comprises a first at least one parameter value, the location comprises a first location, and the at least one processor is further configured to: receive a second at least one parameter value, the second at least one parameter value corresponding to a second location that is different from the first location; determine, based on the first location, the second location, the first at least one parameter value, and the second at least one parameter value, a predicted common point of failure in the power distribution network; and output an indication of the common point of failure.

In one or more examples, the techniques described herein may be implemented in hardware, software, firmware, or any combination thereof. If implemented in software, the functions may be stored on or transmitted over, as one or more instructions or code, a computer-readable medium and executed by a hardware-based processing unit. Computer-readable media may include computer-readable storage media, which corresponds to a tangible medium such as data storage media, or communication media, which includes any medium that facilitates transfer of a computer program from one place to another, e.g., according to a communication protocol. In this manner, computer-readable media generally may correspond to (1) tangible computer-readable storage media, which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable storage medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transient media, but are instead directed to non-transient, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a hardware unit or provided by a collection of inter-operative hardware units, including one or more processors as described above, in conjunction with suitable software and/or firmware.

The foregoing disclosure includes various examples set forth merely as illustration. The disclosed examples are not intended to be limiting. Modifications incorporating the spirit and substance of the described examples may occur to persons skilled in the art. These and other examples are within the scope of this disclosure and the following claims.

What is claimed is:

1. A system comprising:

at least one cable service device comprising a processor and a voltage sensor, wherein:

the at least one cable service device corresponds to a respective at least one power consumption location that is connected to a power distribution network, and the at least one cable service device is configured to:

provide at least one cable service to the power consumption location via a cable television (CATV) distribution network;

determine a voltage value representing a voltage of the power distribution network at the at least one power consumption location; and output the voltage value;

a heterogenous network topology management and control (HNTMC) device comprising a processor and configured to:

receive an indication of the voltage value; and cause at least one device within the power distribution network to modify operation based on the voltage value, wherein:

the HNTMC device is further configured to:

receive an indication of a first geographic area corresponding to a first distribution network;

receive an indication of a second geographic area corresponding to a second distribution network; and determine, based on the first geographic area and the second geographic area, that at least a portion of the first distribution network and at least a portion of the second distribution network overlap in an overlapping geographic area; and causing the at least one device within the power distribution network to modify operation comprises:

determining whether the at least one power consumption location is within the overlapping geographic area; and responsive to determining that the at least one power consumption location is within the overlapping geographic area:

converting the voltage value to a converted voltage value that is understandable by a power distribution network management system; and outputting the converted voltage value.

2. The system of claim 1, wherein:

the at least one cable service device is further configured to:

determine a frequency value representing a frequency of the power distribution network at the at least one power consumption location; and output the frequency value, and the HNTMC device is further configured to:

receive an indication of the frequency value; and cause the at least one device within the power distribution network to modify operation based further on the frequency value.

3. The system of claim 1, wherein:

the cable service device comprises one of: a cable modem, a cable set-top box, or multimedia terminal adapter (MTA), and the at least one cable service comprises at least one of television programming, internet connectivity, or voice over IP (VoIP) services.

4. The system of claim 1, wherein the HNTMC device is further configured to:

receive at least one of a second voltage value representing a voltage of the power distribution network at a second location, the second location being different from the at least one power consumption location or a frequency value representing a frequency of the power distribution network at the second location from a power distribution device; and cause the at least one device within the power distribution network to modify operation based further on the at least one of the second voltage value or the frequency value.

5. The system of claim 1, wherein:

the HNTMC device is further configured to generate, responsive to determining that at least a portion of the first distribution network and at least a portion of the second distribution network overlap, a communication interface that converts power quality parameter information between a first schema that is interpretable by a manager of the first distribution network and a second schema that is interpretable by a manager of the second distribution network, and converting the voltage value comprises converting the voltage value using the communication interface.

6. A device comprising:

at least one processor configured to:

receive an indication of a first geographic area corresponding to a first distribution network;

receive an indication of a second geographic area corresponding to a second distribution network;

determine, based on the first geographic area and the second geographic area, that at least a portion of the first distribution network and at least a portion of the second distribution network overlap in an overlapping geographic area;

receive at least one parameter value obtained by a device within the second distribution network, the at least one parameter value corresponding to a location within the overlapping geographic area; and cause at least one device within the first distribution network to modify operation based on the at least one parameter value of the second distribution network, wherein the at least one processor is further configured to:

responsive to determining that the at least a portion of the first distribution network and the at least a portion of the second distribution network overlap, generate a communication interface for the overlapping geographic area, wherein the communication interface translates parameter values received from the second network into translated parameter values that are interpretable by a distribution network management system of the first distribution network.

7. The device of claim 6, wherein the first distribution network comprises a power distribution network and wherein the second distribution network comprises a cable television (CATV) distribution network.

8. The device of claim 6, wherein the at least one parameter value comprises at least one second network parameter value and wherein the at least one processor is further configured to:

receive at least one first network parameter value of the first distribution network, the at least one first network parameter value corresponding to a location within the overlapping geographic area; and cause at least one device within the second distribution network to modify operation based on the at least one first network parameter value of the first distribution network.

9. The device of claim 6, wherein causing the at least one device within the first distribution network to modify operation comprises:

translating, using the communication interface for the overlapping geographic area, the at least one parameter value into at least one translated parameter value; and outputting, to the distribution network management system, the at least one translated parameter value.

10. The device of claim 6, wherein causing the at least one device within the first network to modify operation comprises:

determining whether or not the at least one parameter value exceeds a threshold;

responsive to determining that the at least one parameter value exceeds the threshold, translating, using the communication interface for the overlapping geographic area, the at least one parameter value into at least one translated parameter value; and outputting, to the distribution network management system, the at least one translated parameter value.

11. The device of claim 10, wherein the threshold comprises at least one of: a value representing a maximum allowable limit; a value representing a minimum allowable limit; or a value representing a maximum deviation from a previous parameter value.

12. The device of claim 6, wherein:

the first distribution network comprises a power distribution network, the at least one parameter value comprises a first at least one parameter value, the location comprises a first location, and the at least one processor is further configured to:

receive a second at least one parameter value, the second at least one parameter value corresponding to a second location that is different from the first location;

determine, based on the first location, the second location, the first at least one parameter value, and the second at least one parameter value, a predicted common point of failure in the power distribution network; and output an indication of the common point of failure.

* * * * *